United States Patent [19]

Carrara

[11] Patent Number: 4,694,756

[45] Date of Patent: Sep. 22, 1987

[54] FURNACE FOR THE COMPLETE, SMOKELESS COMBUSTION OF LIQUID OR PARTIALLY LIQUID MATERIALS

[76] Inventor: Giuseppe Carrara, Via Cavour, 125, Cernusco Sul Naviglio, Italy

[21] Appl. No.: 887,221

[22] Filed: Jul. 21, 1986

[30] Foreign Application Priority Data

Jul. 31, 1985 [IT] Italy ..... 21784 A/85

[51] Int. Cl.[4] ..... F23G 7/04

[52] U.S. Cl. ..... 110/238; 110/237

[58] Field of Search ..... 110/235, 237, 238, 346; 431/331, 332, 335, 342

[56] References Cited

U.S. PATENT DOCUMENTS 4,277,362 7/1981 Mallek et al. ..... 110/238 X 4,398,475 8/1983 McKiel, Jr. ..... 110/237 X

*Primary Examiner*—Edward G. Favors

[57] ABSTRACT

A furnace is disclosed adapted to provide for the complete smokeless combustion of liquid or partially liquid materials. Said furnace can be advantageously used when said materials contain toxic components or compounds. The subject furnace includes a hollow cylindrical body provided at the lower end thereof with a substantially cylindrical body whose opposite end faces carry radially extended projections, of a substantially circular shape. Together with the side surface of said substantially cylindrical body, and with the inner surface of said hollow cylindrical body, said projections enclose an essentially annular combustion chamber. Inside the cylindrical body there is provided passages for supplying to the combustion chamber the materials to be burnt, as well as fuel gas and combustion sustaining gas, said supply process being performed in a substantially radial direction from the center of said cylindrical body out towards said combustion chamber, wherein the combustion takes place both because of the flame effect and because of the cylindrical body and the expansions thereof growing red hot.

7 Claims, 4 Drawing Figures

1
3
12
18
5
4
7
8
II
II
9
24
10
6
10a
2
11
13
F
23

16
18
3
IV
6
5
7
21
4
13
III
III
20
25
10a
15
22
19
1
17
IV

FURNACE FOR THE COMPLETE, SMOKELESS COMBUSTION OF LIQUID OR PARTIALLY LIQUID MATERIALS

FIELD OF THE INVENTION

This invention concerns a furnace for the complete, smokeless combustion of liquid or partially liquid materials.

The materials that can be burnt by means of the subject furnace can be of a nature whatsoever, and the furnace is adapted as well to perform the combustion of oily and generally greasy materials, such as for instance toxic solutions loaded with metal salts, organic matters, cyanides and so on, and in addition mineral and vegetable oils, fatty acids in general. The furnace according to this invention is particularly suitable when the materials to be processed are loaded with toxic contaminants, since no toxic residues are left by the furnace, therefore the problem of waste disposal is completely done away with.

BACKGROUND OF THE INVENTION

The problem of liquid and partially liquid materials combustion has already been tackled and various attempts have been made by means of conventional incinerators. The latter however gave only partial and unsatisfactory results. Those systems, besides requiring a high energy consumption, were affected by a substantial drawback, since large amounts of unburnt residues were left, and large quantities of ill-smelling gases were generated.

SUMMARY OF THE INVENTION

It has now been devised, and it makes the subject of this invention, a complete, smokeless combustion furnace for liquid materials and the like, which overcomes all the drawbacks of the conventional systems.

By means of the furnace provided by this invention, the materials are completely burnt and only limited amounts of inert wastes or residues are generated, while the combustion takes place without smoke generation or ill-smelling gas emission.

BRIEF DESCRIPTION OF THE DRAWINGS

The features and advantages of the furnace according to this invention will become apparent from the detailed description of non-limiting embodiment thereof, wherein reference is made to the attached drawing, in which.

DESCRIPTION OF THE PREFERRED EMBODIMENT

Figure 1:
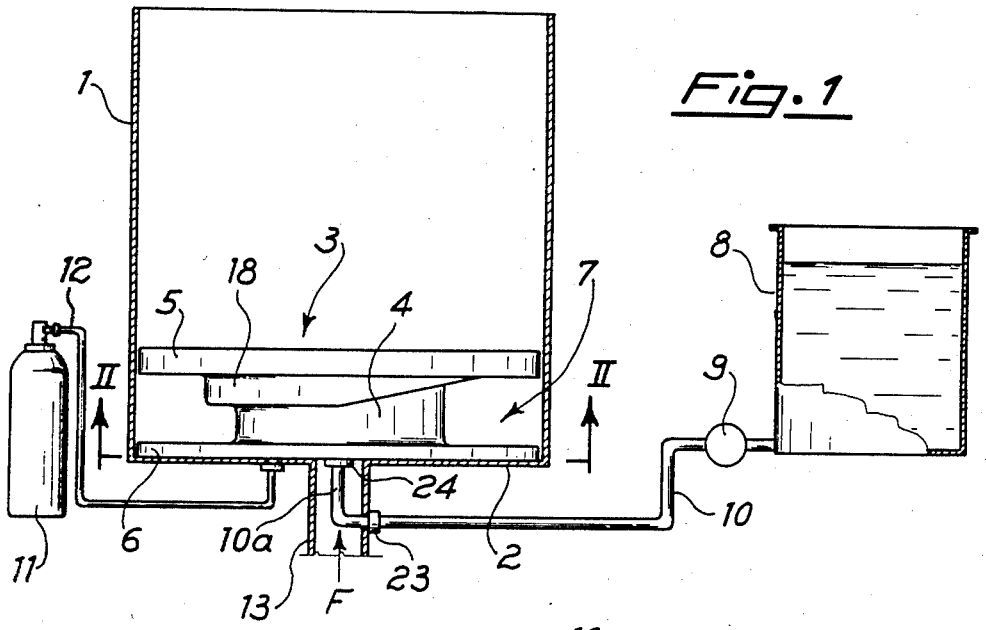
FIG. 1 is an overall schematic view of the furnace according to this invention.

Reference will first be made to FIG. 1, to describe the overall arrangement of the furnace according to this invention.

The furnace includes a hollow cylindrical body 1, open at the top end thereof, while on the lower end 2 thereof a shaped body is provided, which is altogether denoted by 3, and whose peculiar configuration is such as to provide, at the bottom of hollow cylindrical body 1, the furnace combustion chamber, while simultaneously allowing the same to be supplied with the materials to be burnt and with the necessary combustion sustaining gases. The shaped body 3 will be fully described in the following, referring in particular to FIGS. 2 to 4.

The shaped body 3 is essentially comprised of a substantially cylindrical central body 4 concentric relative to hollow cylindrical body 1, and it carries at both ends thereof, two larger diameter circularly shaped expanded portions 5 and 6. Expanded portions 5 and 6 of shaped body 3, together with the side surface of cylindrical body 4, and with the inner wall of hollow cylindrical body 1, enclose a substantially annular combustion chamber 7 wherein the aforesaid materials will be burnt. Shaped body 3 is provided with suitably shaped internal passages, adapted to supply to combustion chamber 7 the materials to be burnt, the fuel gas and the combustion sustaining gas.

The materials to be burnt are carried to the furnace from a supply reservoir 8, by means of a pump 9 and of a duct 10, which is connected to the furnace in a way that will be described more particularly in the following.

The fuel gas arrives to the furnace from a known source of supply, such as for instance a fuel gas cylinder 11, connected to the furnace through a duct 12.

The combustion sustaining gas, air for instance, is fed to the subject furnace according to arrow F, through a duct 13.

Figure 2:
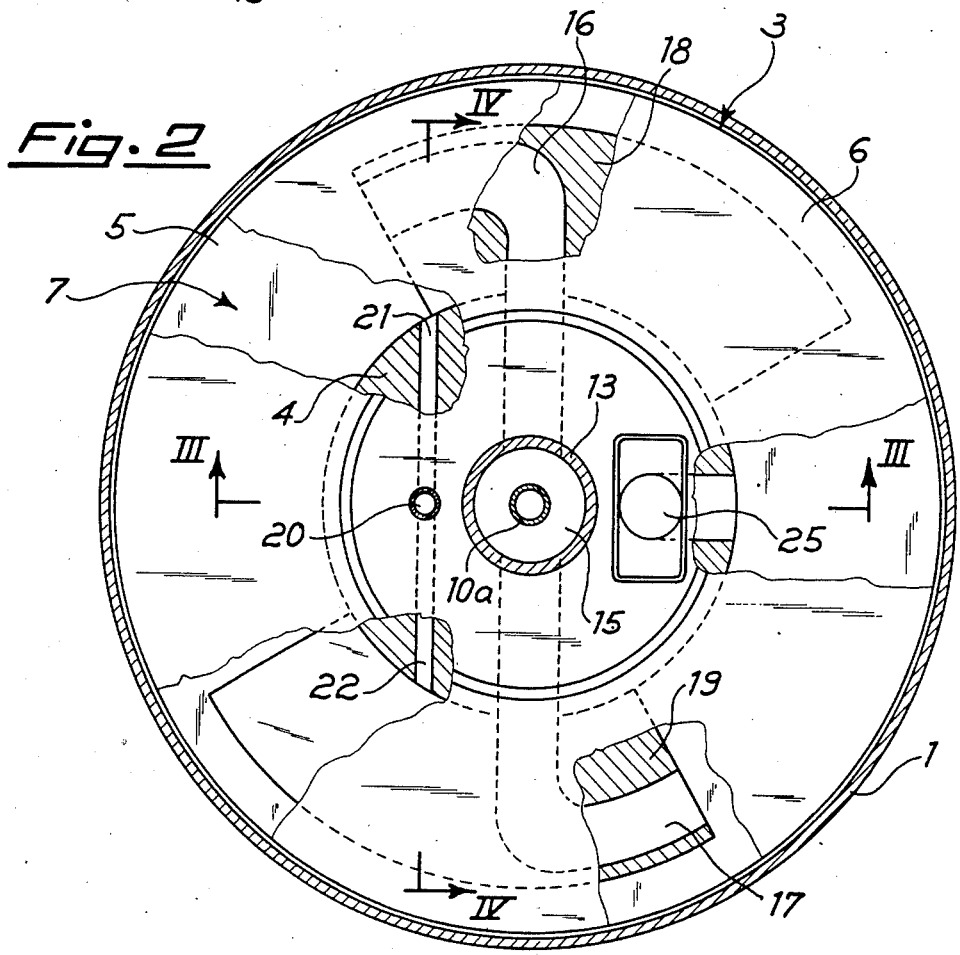
FIG. 2 is a view of the furnace along section line II—II of FIG. 1.
Figure 3:
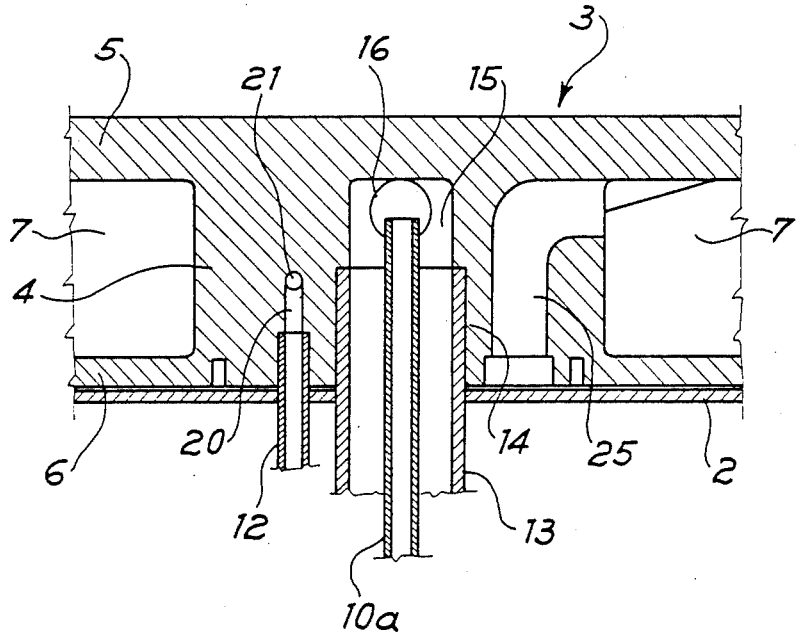
FIG. 3 is a sectional view of the furnace according to line III—III of FIG. 2.
Figure 4:
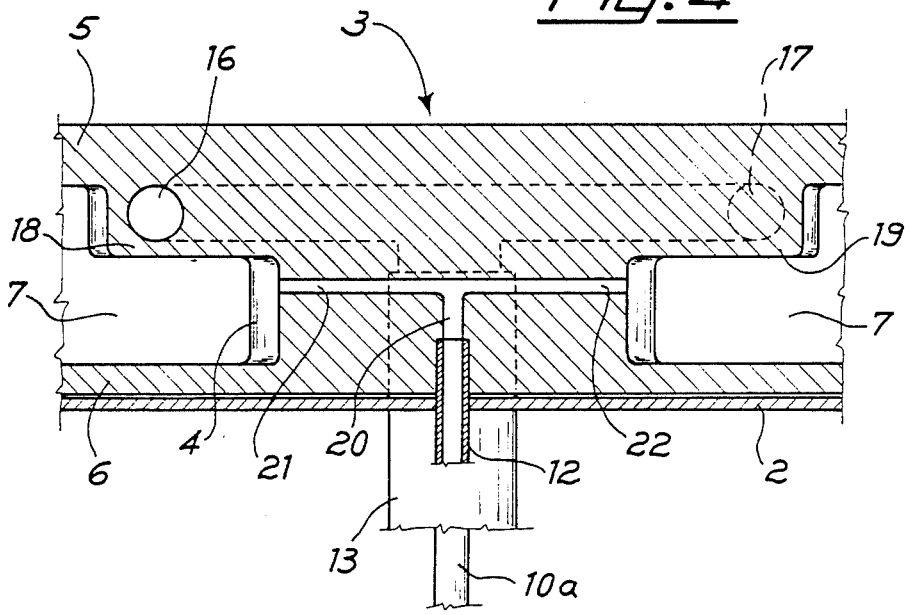
FIG. 4 is a sectional view of the furnace according to line IV—IV of FIG. 2.

Referring now in particular to FIGS. 2 to 4, the internal arrangement of shaped body 3 is described in detail, together with the connection thereof to the above mentioned sources of supply.

It should be particularly noted that in FIG. 2 the furnace according to this invention is shown from the bottom thereof, and this is just the side wherethrough all the materials are fed to the furnace according to the invention.

The various means of supply are now described in detail in the order that is best suited to understand the structure of the furnace according to this invention.

Air is supplied by means of duct 13 which is connected, at one end thereof, to a per se known source of supply, not shown, of compressed air. At the other end duct 13 is fitted, through base 2 of hollow cylindrical body 1, directly onto shaped body 3. In particular the end of duct 13 is sealingly connected with a pressure fit within a corresponding cylindrical cavity 14 defined within cylindrical body 4, for a fraction of the height thereof. Cylindrical cavity 14 extends in a further cavity 15 in communication with the end of duct 13, wherefrom two passages 16 and 17 are originated for air injection to the combustion chamber 7. Passages 16 and 17 are partially located within cylindrical body 4 and, for the remaining length, in extended diameter portions respectively 18 and 19 of the same. The provision for portions 18 and 19 where the end sections of air supply passages 16 and 17 are located, enables the air to be fed, as it is particularly apparent from FIG. 2, in a substantially central location of combustion chamber 7 and in a direction suitable to provide the air with a swirling component within the combustion chamber 7. In fact, a first section of passages 16 and 17 has a substantially radial direction, starting from the center of shaped body 3, and said sections are diametrically opposite. The end portion of passages 16 and 17, ending in combustion chamber 7, is curved relative to the initial section, so that passages 16 and 17 have a substantially L-shaped overall configuration, where the shorter side, which is the end portion, is bent to form a substantially acute angle relative to the starting section. Therefore, the air flow generated by passages 16 and 17 within combustion chamber 7 will follow a generally circular pattern such as to fill completely said combustion chamber.

The fuel gas duct 12, that for instance supplied methane, is fitted as well (FIGS. 3 and 4) through base 2 of hollow cylindrical body 1, and connected to cylindrical body 4 for a portion of the height thereof. At the connection point with fuel gas duct 12, in cylindrical body 4 there is provided a substantially T-shaped multiple passage, where the vertical leg 20 is in direct communication with the end portion of duct 12, while the two branches 21 and 22 laying 180° apart, communicate with combustion chamber 7.

As it is in particular apparent from FIG. 2, the injection of fuel gas in combustion chamber 7 through both ducts 21 and 22 is carried out along a substantially radial direction which is particularly advatageous since the two fuel gas streams run transversely into the substantially circularly oriented air flow, in such a way that the air itself, being pressurized, provides for diffusion of the fuel gas internally of combustion chamber 7.

The materials to be burnt are supplied to the furnace in the following way.

Supply duct 10 for said materials is connected to duct 13 for compressed air supply, and more particularly combustible material duct 10 penetrates (FIG. 1) at right angles through compressed air supply duct 13, at a sealed connection provided by suitable means such as for instance at least a known washer 23. Within duct 13, duct 10 makes a 90° upward turn at an elbow 10*a* in a direction towards shaped body 3. The vertical leg of elbow 10*a* on duct 10, which is concentric relative to compressed air supply duct 13, being always contained within duct 13 and concentric thereof, penetrates inside cylindrical body 4, as it is shown in particular in FIGS. 2 to 4. The vertical leg of duct 10*a*, as it is apparent in particular from FIG. 3, ends within cavity 15 of cylindrical body 4, at the inlet ends of compressed air supply passages 16 and 17 for combustion chamber 7. Thus, the introduction of materials to be burnt and of compressed air into said chamber is carried out by means of the same passages 16 and 17 so that the boosting action of compressed air will promote the forward motion of said materials within passages 16 and 17, and the injection thereof into combustion chamber 7. Moreover, as it is apparent from FIG. 2, also the materials to be burnt will be supplied along the same direction as the compressed air, therefore they will be scattered according to a circular pattern within said chamber, their diffusion inside the same being promoted by the air flow circulating through said chamber. Therefore, there will be uniform distribution, without any pile-up of material in one region rather than in another, and the combustion efficiency will therefore be optimized.

In FIGS. 2 and 3 there is shown at 25 a substantially L-shaped cavity provided within cylindrical body 4, which is adapted to house a known ignition device, such as a spark plug, or similar device, to prime the combustion within chamber 7. However, this is not a relevant matter to the invention, in that the ignition can be performed by means of any method already known.

The advantages of the furnace according to this invention are apparent from the above description, and the most important are summarized in the following.

The compressed air supply flow, following a substantially circular pattern within combustion chamber 7, while the fuel gas is supplied in an essentially radial direction, promotes the diffusion of said fuel gas within combustion chamber 7, therefore the combustion flames fill combustion chamber 7 completely, whereby a high combustion efficiency is attained. Thus, the flames will be particularly intense, they will throughly fill up combustion chamber 7 allowing for high combustion temperatures to be reached, which will provide for a complete combustion of the materials to be burnt, as they are supplied to the combustion chamber.

The supply method whereby the materials to be burnt are fed through the same passages used for supplying compressed air to the combustion chamber 7, provides a uniform diffusion of said materials within said chamber, which will be a factor, together with the intensity and uniformity of the resulting flame, in further obtaining a complete combustion of said materials.

Moreover, the substantially circular compressed air flow patten within combustion chamber 7, will result in a "dynamic" combustion process, whereby said combustion will take place according to a substantially non-laminar swirling condition that is a further factor contributing to an improvement in the level of combustion efficiency.

An additional advantage, deriving from the particularly high temperatures established within combustion chamber 7, resides in the fact that cylindrical body 4 and the expanded portions 5 and 6 thereof are as well brought to said elevated temperature values growing red hot, whereby also the heat emitted by the latter will contribute to the combustion process.

It is worth to emphasize the fact that by suitable variations of the flowrates of combustion sustaining gases, fuel gases, and materials to be burnt, the combustion of the latter can be optimized.

Eventually, it is understood that variations and/or modifications can be made to the furnace according to this invention, without exceeding the scope of protection of the invention.

What I claim is:

1. A furnace for complete smokeless combustion of liquid or partially liquid materials, wherein it includes, at the lower end of a hollow cylindrical body open at the top thereof, a cylindrical body provided, at the opposite ends thereof, with expanded portions, said expanded portions together with the side surface of cylindrical body and the opposite internal surface of hollow cylindrical body, enclosing a combustion chamber wherein there is injected the materials to be burnt, a fuel gas and a combustion sustaining gas, by means of suitable passages provided inside cylindrical body, said passages being connected for that purpose to sources of supply of said products.

2. A furnace according to claim 1, wherein said cylindrical body is provided, at the lower portion thereof, and for a part of the height thereof, with a passage wherein the end of compressed air supply duct is fitted, said passage being in communication with a cavity wherefrom at least two passages originate, for compressed air injection to the interior of combustion chamber.

3. A furnace according to claim 2, wherein end of combustible material supply duct to the furnace, is located substantially concentric relative to compressed air supply duct, internally thereof, said end portion ending within the same cavity wherefrom air supply passages originate, whereby said materials to be burnt are injected into combustion chamber through said passages.

4. A furnace according to claim 2, wherein said passages are symmetrically located relative to a diametral plane of cylindrical body and are provided with an initial radially oriented portion out of the center of cylindrical body, and an end section, provided within an expanded diameter portion of cylindrical body, which is bent in a direction substantially parallel to the inside wall of hollow cylindrical body, in an essentially central region within combustion chamber, whereby the compressed air and the materials to be burnt injected in said chamber will be distributed inside the same according to a circumferential pattern.

5. A furnace according to claim 1, wherein cylindrical body has a substantially longitudinal passage which receives the fuel gas from a supply duct and branches into at least two diametrically opposite passages, ending each in combustion chamber.

6. A furnace according to claim 5, wherein the longitudinal centerline of said passages is substantially parallel to the radial straight portion of passages that supply compressed air and the materials to be burnt.

7. A furnace according to claim 1, wherein the compressed air, the fuel gas, and the materials to be burnt are supplied from the lower end of hollow cylindrical body.

* * * * *